US008865633B2

(12) United States Patent
MacPherson et al.

(10) Patent No.: US 8,865,633 B2
(45) Date of Patent: Oct. 21, 2014

(54) GEAR OIL COMPOSITIONS

(75) Inventors: Ian MacPherson, Richmond, VA (US); Donald Robert Bell, Midlothian, VA (US); Akhilesh Duggal, Midlothian, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 13/216,278

(22) Filed: Aug. 24, 2011

(65) Prior Publication Data

US 2013/0053288 A1 Feb. 28, 2013

(51) Int. Cl.
*C10M 159/12* (2006.01)
*C10M 161/00* (2006.01)

(52) U.S. Cl.
CPC ..... *C10M 161/00* (2013.01); *C10M 159/12* (2013.01); *C10M 2203/1025* (2013.01); *C10M 2203/1085* (2013.01); *C10M 2205/028* (2013.01); *C10M 2217/06* (2013.01); *C10M 2219/08* (2013.01); *C10M 2219/082* (2013.01); *C10M 2219/083* (2013.01); *C10M 2219/086* (2013.01); *C10N 2230/02* (2013.01); *C10N 2230/04* (2013.01); *C10N 2230/08* (2013.01); *C10N 2230/10* (2013.01); *C10N 2230/12* (2013.01); *C10N 2230/68* (2013.01); *C10N 2240/04* (2013.01)
USPC ..... 508/563; 508/569; 508/459

(58) Field of Classification Search
USPC ..... 508/563, 459, 569
See application file for complete search history.

(56) References Cited

U.S. PATENT DOCUMENTS

| | | | | |
|---|---|---|---|---|
| 2,945,749 | A | 7/1960 | Andress et al. | |
| 3,663,561 | A | 5/1972 | Blaha | |
| 4,097,387 | A | 6/1978 | Caspari | |
| 6,107,257 | A * | 8/2000 | Valcho et al. | 508/221 |
| 6,117,941 | A | 9/2000 | Adams et al. | |
| 6,544,935 | B1 | 4/2003 | Vargo et al. | |
| 6,573,221 | B2 | 6/2003 | Talashek et al. | |
| 7,790,661 | B2 | 9/2010 | Covitch et al. | |
| 2004/0147410 | A1 | 7/2004 | Milner et al. | |
| 2005/0090410 | A1 | 4/2005 | Devlin et al. | |
| 2006/0025316 | A1 * | 2/2006 | Covitch et al. | 508/459 |
| 2007/0027267 | A1 | 2/2007 | Ruhe, Jr. et al. | |
| 2008/0300155 | A1 * | 12/2008 | Buitrago | 508/156 |

FOREIGN PATENT DOCUMENTS

| | | |
|---|---|---|
| CN | 1616614 A | 5/2005 |
| WO | 0130947 | 5/2001 |
| WO | 0198387 | 12/2001 |
| WO | WO 2007003623 A1 * | 1/2007 |

* cited by examiner

*Primary Examiner* — James Goloboy
(74) *Attorney, Agent, or Firm* — Luedeka Neely Group, P.C.

(57) ABSTRACT

A gear oil composition, a method for operating an automotive gear, and a method for improving performance of a gear oil that includes a) a major amount of a base oil having a lubricating viscosity; b) a polysulfide extreme pressure agent; and c) a reaction product of an acylated copolymer and a polyamine.

9 Claims, No Drawings

GEAR OIL COMPOSITIONS

FIELD

The present disclosure relates to gear oil compositions, and in particular to gear oil additive compositions, gear oil compositions, methods for lubricating automotive gears using inferior base stocks.

BACKGROUND AND SUMMARY

Lubricants are used to reduce wear between moving parts where there is metal to metal contact and to remove heat from the parts. The lubricants typically contain a high viscosity base stock and a variety of additives to improve wear, friction coefficient, oxidation resistance and the like. Automotive gear applications are typically formulated for a base oil having a viscosity at 100° C. of about 30 cSt or more and a viscosity index of greater than about 80, known as Bright Stock. Such Bright Stock base oil is particularly suitable for gear applications due to its ability to remain clear and maintain suitable viscometric properties under extreme operating conditions. However, from time to time, the availability of Bright Stock base oils may become limited or the price may become excessive. Accordingly, there is a need for gear oil formulations that may be used to provide comparable or superior lubricating characteristics with a mixture of base oils containing base oil components having a viscosity of less than 30 cSt at 100° C. and a viscosity index of less than 80.

With regard to the foregoing, the disclosure provides a gear oil lubricant composition that includes a) a major amount of a base oil having a lubricating viscosity; b) a polysulfide extreme pressure agent; and c) a reaction product of an acylated copolymer and a polyamine.

In another embodiment there is provided a method for lubricating an automotive gear by providing a lubricant composition that includes a) a major amount of a base oil having a lubricating viscosity; b) a polysulfide extreme pressure agent; and c) a reaction product of an acylated copolymer and a polyamine.

A further embodiment of the disclosure provides a lubricant additive concentrate for a gear oil lubricant composition. The additive includes a) a polysulfide extreme pressure agent and b) a dispersant viscosity modifier that is a reaction product of an acylated copolymer and a polyamine.

In yet another embodiment there is provided a method of operating a vehicle containing a drive axle. The method includes providing as a lubricant for the drive axle a composition containing a) a base oil of lubricating viscosity, b) a polysulfide extreme pressure agent, and c) a dispersant viscosity modifier that is a reaction product of an acylated copolymer and a polyamine.

An advantage of compositions according to the disclosure is that a wider variety of base oils may be used to prepare the lubricant compositions for automotive gear applications. Accordingly, base oils that would not provide suitable thermal and oxidative stability and shear stability for automotive gear applications in the absence of the additive combination of the disclosure, may be used as total or partial replacement for Bright Stock base oils for such applications. Another advantage is that the lubricant compositions according to the disclosure may be formulated from commercially available components. The following detailed description of embodiments may provide other advantages.

DETAILED DESCRIPTION OF EMBODIMENTS

As used herein, the term "hydrocarbyl substituent" or "hydrocarbyl group" is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, such as no more than one, non-hydrocarbon substituent will be present for every ten carbon atoms in the hydrocarbyl group; typically, there will be one non-hydrocarbon substituent in the hydrocarbyl group.

Lubricant compositions according to the disclosure contain a base oil component, an extreme pressure agent and a reaction product of an acylated copolymer and a polyamine. The lubricant compositions of the disclosure may provide gear oil compositions that meet or exceed the thermal and oxidative stability, sludge and carbon/varnish limits for clean-gear tests and have no aesthetic issues with respect to the additive concentrate for automotive gear oil applications. An important criteria that may be met by the lubricant compositions described herein is that the gear oil composition has a shear stability that enables the composition to stay within the required viscosity grade for the gear oil Base Oil Component The base oils useful as component (a) include natural lubricating oils, synthetic lubricating oils, and mixtures thereof. Suitable lubricating oils also include basestocks obtained by isomerization of synthetic wax and slack wax, as well as basestocks produced by hydrocracking the aromatic and polar components of the crude. In general, both the natural and synthetic lubricating oils will each have a kinematic viscosity ranging from about 1 to about 40 $mm^2/s$ (cSt) at 100 DEG C., although typical applications will require each of the base oils to have a viscosity ranging from about 1 to about 16 $mm^2/s$ (cSt) at 100 DEG C., preferably 2 to 15 $mm^2/s$ (cSt) at 100° C.

Natural lubricating oils include animal oils, vegetable oils (e.g., castor oil and lard oil), petroleum oils, mineral oils, and oils derived from coal or shale. The preferred natural lubricating oil comprises mineral oil.

The mineral oils useful in this invention can include but are not limited to all common mineral oil base stocks. This would include oils that are naphthenic or paraffinic in chemical structure. Oils that are refined by conventional methodology using acid, alkali, and clay or other agents such as aluminum chloride, or be extracted oils produced, for example, by solvent extraction with solvents such as phenol, sulfur dioxide, furfural, dichlorodiethyl ether, etc. The oils may be hydrotreated or hydrorefined, dewaxed by chilling or catalytic dewaxing processes, or hydrocracked. The mineral oil may be produced from natural crude sources or be composed of isomerized wax materials or residues of other refining processes. In one embodiment, the oil of lubricating viscosity is a hydrotreated, hydrocracked and/or iso-dewaxed mineral oil having a Viscosity Index (VI) of greater than 80, preferably greater than 90; greater than 90 volume % saturates and less than 0.03 wt. % sulfur.

Group II and Group III basestocks are also particularly suitable for use in the present invention, and are typically prepared from conventional feedstocks using a severe hydrogenation step to reduce the aromatic, sulfur and nitrogen content, followed by dewaxing, hydrofinishing, extraction and/or distillation steps to produce the finished base oil. Also useful herein are base oils known as Group III, <=0.03 wt. % sulfur, and >=90 vol % saturates, viscosity index>120; and Group IV, poly-alpha-olefins. Hydrotreated basestocks and catalytically dewaxed basestocks, because of their low sulfur and aromatics content, generally fall into the Group II and Group III categories.

There is no limitation as to the chemical composition of the various basestocks used in the present invention. For example, the proportions of aromatics, paraffinics, and naphthenics in the various Group I, Group II and Group III oils can vary substantially. The degree of refining and the source of the crude used to produce the oil generally determine this composition. In one embodiment, the base oil comprises a mineral oil having a VI of at least 110.

The lubricating oils may be derived from refined, re-refined oils, or mixtures thereof. Unrefined oils are obtained directly from a natural source or synthetic source (e.g., coal, shale, or tar sands bitumen) without further purification or treatment. Examples of unrefined oils include shale oil obtained directly from a retorting operation, petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Re-refined oils are obtained by treating used oils in processes similar to those used to obtain the refined oils. These re-refined oils are also known as reclaimed or reprocessed oils and are often additionally processed by techniques for removal of spent additives and oil breakdown products.

Synthetic lubricating oils include hydrocarbon oils and halo-substituted hydrocarbon oils such as oligomerized, polymerized, and interpolymerized olefins; alkylbenzenes; polyphenyls; and alkylated diphenyl ethers, alkylated diphenyl sulfides, as well as their derivatives, analogs, and homologs thereof, and the like. Preferred synthetic oils are oligomers of alpha-olefins, particularly oligomers of 1-decene, having a viscosity ranging from about 1 to about 12, preferably 2 to 8, $mm^2/s$ (cSt) at 100° C. These oligomers are known as poly-alpha-olefins or PAOs.

Synthetic lubricating oils also include alkylene oxide polymers, interpolymers, copolymers, and derivatives thereof where the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 100-1500); and mono- and poly-carboxylic esters thereof (e.g., the acetic acid esters, mixed $C_3$-$C_8$ fatty acid esters, and $C_{12}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, subric acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl)sebacate, di-n-hexyl fumarate, dioctyl sebacate, diisooctyl azelate, diisodecyl azelate, dioctyl isothalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethyl-hexanoic acid, and the like. A preferred type of oil from this class of synthetic oils is adipates of $C_4$ to $C_{12}$ alcohols.

Esters useful as synthetic lubricating oils also include those made from $C_5$ to $C_{12}$ monocarboxylic acids and polyols and polyol ethers such as neopentyl glycol, trimethylolpropane pentaeythritol, dipentaerythritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetra-ethyl silicate, tetra-isopropyl silicate, tetra-(2-ethylhexyl)silicate, tetra-(4-methyl-2-ethylhexyl)silicate, tetra-(p-tert-butylphenyl)silicate, hexa-(4-methyl-2-pentoxy)-disiloxane, poly(methyl)-siloxanes and poly(methylphenyl)siloxanes, and the like. Other synthetic lubricating oils include liquid esters of phosphorus containing acids (e.g., tricresyl phosphate, trioctylphosphate, and diethyl ester of decylphosphonic acid), polymeric tetra-hydrofurans, poly-alpha-olefins, and the like.

Extreme Pressure Agent

A suitable extreme pressure agent for use as component (b) in the gear oil compositions described herein may be selected from a variety of oil-soluble metal-free hydrocarbyl polysulfides. In a preferred embodiment, the hydrocarbyl polysulfide is an alkyl polysulfide. In a further preferred embodiment, the alkyl polysulfide is a mixture of tetra-, tri- and/or di-sulfide such that the sulfur activity is greater than 125 mg in the CCT bench test. This allows for sufficient EP performance without having very high treat rates or the addition of other EP components. The hydrocarbyl portion of the extreme pressure agent may be selected from the group consisting of: aliphatic hydrocarbon groups with straight or branched carbon chain of about 2 to about 15 carbon atoms, saturated or unsaturated, alkyl groups, alkenyl groups and aromatic hydrocarbon groups. Specifically, the hydrocarbyl portion may include, without limitation, ethyl, 1-propyl, 2-propyl, n-butyl, t-butyl, nonyl, propenyl, butenyl, benzyl, phenyl, etc.

Hydrocarbyl polysulfides may include, without limitation, dicyclohexyl polysulfide, diphenyl polysulfide, dibenzyl polysulfide, dinonyl polysulfide, and mixtures of di-t-butyl polysulfides such as mixtures of di-t-butyl trisulfide, di-t-butyl tetrasulfide and di-t-butyl pentasulfide.

The amount of extreme pressure agent in the gear oil additive package may range from about 20 to about 60 percent by weight of the total weight of the additive package. In terms of active sulfur content in the lubricant compositions, the lubricant composition may contain from about 1 wt. % to about 3 wt. % active sulfur.

Multifunction-Olefin Copolymer

Component (c) of the compositions described herein include the reaction product of (a) a polymer comprising carboxylic acid functionality or a reactive equivalent thereof, said polymer having a number average molecular weight of greater than 5,000; and (b) an amine component comprising at least one aromatic amine containing at least one amino group capable of condensing with said carboxylic acid functionality to provide a pendant group and at least one additional group comprising at least one nitrogen, oxygen, or sulfur atom selected from the group consisting of:

(a) an aromatic amine comprising two aromatic groups linked by a group, L, represented by the following formula.

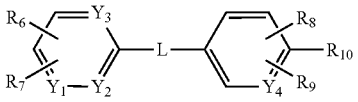

wherein L is selected from —O—, —N═N—, —NH—, —$CH_2NH$—, —C(O)$NR^4$—, —C(O)O—, —$SO_2$—, —$SO_2NR^5$— or —$SO_2NH$—, wherein $R^4$ and $R^5$ independently represent a hydrogen, an alkyl, an alkenyl or an alkoxyl group having from about 1 to about 8 carbon atoms; wherein each $Y_1$, $Y_2$, $Y_3$ and $Y_4$ are independently N or CH provided that $Y_1$ and $Y_2$ may not both be N; $R^6$ and $R^7$ independently represent a hydrogen, —OH, —$NO_2$, —$O_3H$, —S03Na, —$CO_2H$ or salt thereof, —NH-aryl, —NH-alkyl, —NH-alkaryl, —NH-aralkyl having up to about 24 carbon atoms or a branched or straight chain group having from about 4 to about 24 carbon atoms that can be alkyl, alkenyl, alkoxyl, aralkyl, alkaryl, hydroxyalkyl or aminoalkyl; $R^8$ and $R^9$ independently represent a hydrogen, an alkyl, an alkenyl or an alkoxyl group having from about 1 to about 8 carbon atoms, —OH, —$SO_3H$ or —$SO_3Na$; and $R_{10}$ represents —$NH_2$, —$NHR^{11}$ wherein $R^{11}$ is an alkyl or an alkenyl group having from about 1 to about 8 carbon atoms, —$CH_2$—$(CH_2)_n$—NH2 or —CH, -aryl-NH2 and n is from 0 to about 10;

(b) an aminothiazole selected from the group consisting of aminothiazole, aminobenzothiazole, aminobenzothiadiazole and aminoalkylthiazole;

(c) an aminocarbazole represented by the formula:

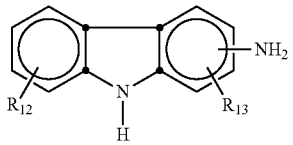

wherein $R^{12}$ and $R^{13}$ independently represent a hydrogen, an alkyl or alkenyl group having from about 1 to about 14 carbon atoms;

(d) an aminoindole represented by the formula:

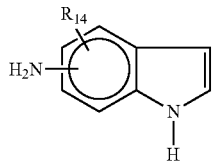

wherein R14 represents a hydrogen, an alkyl or alkenyl group having from about 1 to about 14 carbon atoms;

(e) an aminopyrrole represented by the formula:

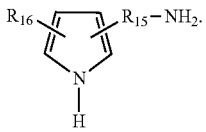

wherein $R^{15}$ represents a divalent alkylene group having about 2 to about 6 carbon atoms and $R^{16}$ represents: a hydrogen, an alkyl or an alkenyl group having from about 1 to about 14 carbon atoms;

(f) an amino-indazolinone represented by the formula:

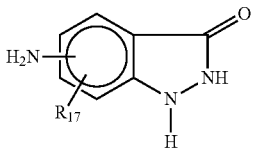

wherein $R^{17}$ represents a hydrogen, an alkyl or an alkenyl group having from about 1 to about 14 carbon atoms;

(g) an aminomercaptotriazole represented by the formula:

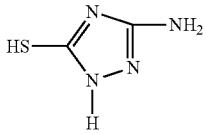

(h) an aminopyrimidine represented by the formula:

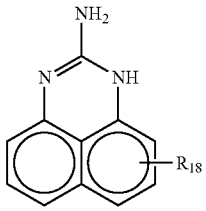

wherein $R^{18}$ represents a hydrogen; an alkyl, an alkenyl, or an alkoxyl group having from about 1 to about 8 carbon atoms;

(i) a ring substituted or unsubstituted aniline, such as nitroaniline or 4-aminoacetanilide;

(j) an aminoquinoline;

(k) an aminobenzimidazole;

(l) a N,N-dialkylphenylenediamine; and (m) a benzylamine.

Preferably, the amine is an aromatic amine selected from the group consisting of (a) an N-arylphenylenediamine represented by the formula:

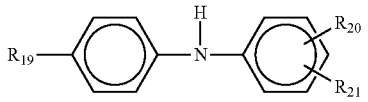

wherein $R^{19}$ represents a hydrogen, —NH-aryl, —NH-alkyl, —NH-alkaryl, —NH-aralkyl having up to about 24 carbon atoms or a branched or straight chain having from about 4 to about 24 carbon atoms that can be alkyl, alkenyl, alkoxyl, aralkyl, alkaryl, hydroxyalkyl or aminoalkyl; $R^{20}$ represents —$NH_2$, —$CH_2$—$(CH_2)_nNH_2$, —$CH_2$-aryl-$NH_2$ and n is from about 1 to about 10; and $R^{21}$ represents a hydrogen, an alkyl an alkenyl, an alkoxyl, an aralkyl or an alkaryl group having about 4 to about 24 carbon atoms;

(b) a phenoxyaniline represented by the formula:

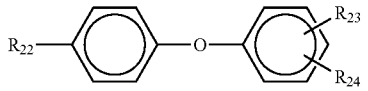

wherein $R^{22}$ represents a hydrogen, —NH-aryl, —NH-alkyl, —NH-alkaryl, —NH-aralkyl having up to about 24 carbon atoms or a branched or straight chain having from about 4 to about 24 carbon atoms that can be alkyl, alkenyl, alkoxyl, aralkyl, alkaryl, hydroxyalkyl or aminoalkyl; $R^{23}$ represents —$NH_2$, —$CH_2$—$(CH_2)_nNH_2$, —$CH_2$-aryl-$NH_2$ and n is from about 1 to about 10; and $R^{24}$ represents a hydrogen, an alkyl an alkenyl, alkoxyl, an aralkyl or an alkaryl group having about 4 to about 24 carbon atoms; and (c) 4-anilino-4'-nitroazobenzene.

The polymer or copolymer substrate employed in the novel derivatized graft copolymer of the invention is not particularly limited, provided that it contains carboxylic acid functionality or a reactive equivalent of carboxylic acid functionality (e.g., anhydride or ester). The polymer may contain the reactive carboxylic acid functionality as a monomer copolymerized within the chain, or it may be present as a pendant group attached by, for instance, a grafting process. Examples of suitable carboxylic-acid containing polymers include maleic anhydride-styrene copolymers, including partially esterified versions thereof. Nitrogen-containing esterified carboxyl-containing interpolymers prepared from maleic anhydride and styrene-containing polymers are known from U.S. Pat. No. 6,544,935, Vargo et al. Other polymer backbones have also been used for preparing dispersants. For example, polymers derived from isobutylene and isoprene have been used in preparing dispersants and are reported in PCT publication WO 01/98387. Other polymer backbones include substantially hydrogenated copolymers of vinyl aromatic materials such as styrene and unsaturated hydrocarbons such as conjugated dienes, e.g., butadiene or isoprene. In substantially hydrogenated polymers of this type the olefinic unsaturation is typically substantially completely hydrogenated by known methods, but the aromatic unsaturation may remain. Such polymers can include random copolymers, block copolymers, or star copolymers. Yet other suitable backbone polymers include styrene-ethylene-alpha olefin polymers, as described in PCT publication WO 01/30947, and polyacrylates or polymethacrylates. In the case of such poly(meth)acrylates, the (meth)acrylate monomers within the polymer chain itself may serve as the carboxylic acid functionality or reactive equivalent thereof which is used to react with the amine component, described below. Alternatively, additional acid functionality may be copolymerized into the (meth)acrylate chain or even grafted onto it, particularly in the case of acrylate polymers.

In certain embodiments, the polymer may be prepared from ethylene and propylene or it may be prepared from ethylene and a higher olefin within the range of (C3-C10) alpha-monoolefins, in either case grafted with a suitable carboxylic acid-containing species (i.e., monomer).

More complex polymer substrates, often designated as interpolymers, may be prepared using a third component. The third component generally used to prepare an interpolymer substrate is a polyene monomer selected from conjugated or non-conjugated dienes and trienes. The non-conjugated diene component is one having from about 5 to about 14 carbon atoms. Preferably, the diene monomer is characterized by the presence of a vinyl group in its structure and can include cyclic and bicyclo compounds. Representative dienes include 1,4-hexadiene, 1,4-cyclohexadiene, dicyclopentadiene, 5-ethylidene-2-norbornene, 5-methylene-2-norbornene, 1,5-heptadiene, and 1,6-octadiene. A mixture of more than one diene can be used in the preparation of the interpolymer.

The triene component will have at least two non-conjugated double bonds and up to about 30 carbon atoms. Typical trienes useful in preparing the interpolymer of the invention are 1-isopropylidene-3a,4,7,7a-tetrahydroindene, 1-isopropylidenedicyclopentadiene, and 2-(2-methylene-4-methyl-3-pentenyl)-[2.2.1]bicyclo-5-heptene.

Suitable backbone polymers of the olefin polymer variety include ethylene propylene copolymers, ethylene propylene copolymers further containing a non-conjugated diene, and isobutylene/conjugated diene copolymers, each of which can be subsequently supplied with grafted carboxylic functionality.

The polymerization reaction to form the olefin polymer substrate is generally carried out in the presence of a catalyst in a solvent medium. The polymerization solvent may be any suitable inert organic solvent that is liquid under reaction conditions for solution polymerization of monoolefins, which can be conducted in the presence of a Ziegler-Natta type catalyst or a metallocene catalyst.

In a typical preparation of a polymer substrate, hexane is first introduced into a reactor and the temperature in the reactor is raised moderately to about 30° C. Dry propylene is fed to the reactor until the pressure reaches about 130-150 kPa above ambient (40-45 inches of mercury). The pressure is then increased to about 200 kPa (60 inches of mercury) by feeding dry ethylene and 5-ethylidene-2-norbornene to the reactor. The monomer feeds are stopped and a mixture of aluminum sesquichloride and vanadium oxytrichloride is added to initiate the polymerization reaction. Completion of the polymerization reaction is evidenced by a drop in the pressure in the reactor.

Ethylene-propylene or higher alpha monoolefin copolymers may consist of 15 to 80 mole % ethylene and 20 to 85 mole % propylene or higher monoolefin, in some embodiments, the mole ratios being 30 to 80 mole % ethylene and 20 to 70 mole % of at least one C3 to C10 alpha monoolefin, for example, 50 to 80 mole % ethylene and 20 to 50 mole % propylene. Terpolymer variations of the foregoing polymers may contain up to 15 mole % of a non-conjugated diene or triene.

In these embodiments, the polymer substrate, that is, typically the ethylene copolymer or terpolymer, can be an oil soluble, substantially linear, rubbery material. Also, in certain embodiments the polymer can be in forms other than substantially linear, that is, it can be a branched polymer or a star polymer. The polymer can also be a random copolymer or a block copolymer, including di-blocks and higher blocks, including tapered blocks and a variety of other structures. These types of polymer structures are known in the art and their preparation is within the abilities of the person skilled in the art.

The polymer of the present invention may have a number average molecular weight (by gel permeation chromatography, polystyrene standard), which can typically be up to 150,000 or higher, e.g., 1,000 or 5,000 to 150,000 or to 120,000 or to 100,000, e.g., 10,000 to 50,000 and especially 10,000 to 15,000 (e.g., about 12,000) or 30,000 to 50,000 (e.g., about 40,000). In one embodiment, the polymer (that is, the polymer absent the amine component) has a number average molecular weight of greater than 5,000, for instance, greater than 5000 to 150,000. Other combinations of the above identified molecular weight limitations are also contemplated.

The terms polymer and copolymer are used generically to encompass ethylene and/or higher alpha monoolefin polymers, copolymers, terpolymers or interpolymers. These materials may contain minor amounts of other olefinic monomers so long as their basic characteristics are not materially changed.

An ethylenically unsaturated carboxylic acid material is typically grafted onto the polymer backbone. These materials which are attached to the polymer typically contain at least one ethylenic bond (prior to, reaction) and at least one, preferably two, carboxylic acid (or its anhydride) groups or a polar group which is convertible into said carboxyl groups by oxidation or hydrolysis. Maleic anhydride or a derivative thereof is suitable. It grafts onto the ethylene copolymer or terpolymer to give two carboxylic acid functionalities. Examples of additional unsaturated carboxylic materials include chloromaleic anhydride, itaconic anhydride, or the corresponding dicarboxylic acids, such as maleic acid, fumaric acid and their esters.

The ethylenically unsaturated carboxylic acid material may be grafted onto the polymer (preferably an ethylene/propylene copolymer) in a number of ways. It may be grafted onto the polymer in solution or in molten form using a radical initiator. The free-radical induced grafting of ethylenically unsaturated carboxylic acid materials may also be conducted in solvents, such as hexane or mineral oil. It may be carried out at an elevated temperature in the range of 100° C. to 250° C., e.g., 120° C. to 190° C., or 150° C. to 180° C., e.g., a If it is conducted in a solvent such as a mineral lubricating oil solution, the solution may contain, e.g., 1 to 50 wt. %, or 5 to 30 wt. %, based on the initial total oil solution, of the ethylene/propylene copolymer, typically under an inert environment.

The free-radical initiators which may be used include peroxides, hydroperoxides, and azo compounds, typically those which have a boiling point greater than about 100° C. and which decompose thermally within the grafting temperature range to provide free radicals. Representative of these free-radical initiators include azobisisobutyronitrile and 2,5-dimethyl-hex-3-yne-2,5-bis-tertiary-butyl peroxide. The initiator is typically used in an amount of 0.005% to 1% by weight based on the weight of the reaction mixture solution. The grafting is typically carried out in an inert atmosphere, such as under nitrogen blanketing. The resulting polymer intermediate is characterized by having carboxylic acid acylating functions within its structure.

In a melt process for forming a graft polymer, the unsaturated carboxylic acid with the optional use of a radical initiator is grafted onto molten rubber using rubber masticating or shearing equipment. The temperature of the molten material in this process may be 150° C. to 400° C. Optionally, as a part of this process or separate from this process, mechanical shear and elevated temperatures can be used to reduce the molecular weight of the polymer to a value that will eventually provide the desired level of shear stability for the lubricant application. In one embodiment, such mastication can be done in a twin screw extruder properly configured to provide high shear zones, capable of breaking down the polymer to the desired molecular weight. Shear degradation can be done before or after grafting with the maleic anhydride. It can be done in the absence or presence of oxygen. The shearing and grafting steps can be done in the same extruder or in separate extruders, in any order.

In an alternative embodiment, the unsaturated carboxylic acid materials, such as maleic anhydride, can be first condensed with an aromatic amine (described below) and the condensation product itself then grafted onto the polymer backbone in analogous fashion to that described above.

The amount of the reactive carboxylic acid on the polymer chain, and in particular the amount of grafted carboxylic acid on the chain is typically 1 to 5 weight percent based on the weight of the polymer backbone, and in an alternative embodiment, 1.5 to 3.5 or 4.0%. These numbers represent the amount of carboxylic-containing monomer such as maleic anhydride and may be adjusted to account for acid monomers having higher or lower molecular weights or greater or lesser amounts of acid functionality per molecule, as will be apparent to the person skilled in the art.

The carboxylic acid functionality can also be provided by reactive equivalent thereof of the general formula $R^3C(O)(R^4)_nC(O)OR^5$. In this formula $R^3$ and $R^5$ are hydrogen or hydrocarbyl groups and $R^4$ is a divalent hydrocarbylene group. n is 0 or 1. Also include are the corresponding acetals, hemiacetals, ketals, and hemiketals. Preparation of grafts of such glyoxylic materials onto hydrocarbon-based polymers is described in detail in U.S. Pat. No. 6,117,941.

The reaction between the polymer substrate intermediate having carboxylic acid functionality and the amino-aromatic compound is conducted by heating a solution of the polymer under inert conditions and then adding the amino-aromatic compound to the heated solution, generally with mixing, to effect the reaction. It is convenient to employ an oil solution of the polymer substrate heated to about 140° C. to about 175° C. while maintaining the solution under a nitrogen blanket.

The amino-aromatic compound is added to this solution and the reaction is effected under the noted conditions. Reaction can also be conducted in a melt of the polymer, e.g., in an extruder or other shearing/mixing environment. Vacuum may be applied to the reaction mixture if desired, e.g., to remove water and aid in driving the reaction to completion.

The gear oil formulations described herein may contain from about 1 to about 3 wt. % of component (c) based on a total weight of the gear oil formulation. Relative to the amount of component (b), a weight ratio of component (c) to component (b) in the gear oil formulation may range from about 0.3:1 to about 1.5:1.

Gear Oil Additive Package Components

The gear additive concentrates and lubricant formulations typically contain one or more of the following components: corrosion inhibitors, antiwear additives, rust inhibitors, antioxidants, defoamers, and a process oil. The gear additive package may be, although it does not have to be, a fully-formulated gear additive package, such as a package meeting the requirements for API GL-5 and/or API MT-1 and/or SAE J2360 (MIL-PRF-2105E) and/or AGMA 9005-D94. The type and amount of the components present in the gear additive package will depend on the intended final use of the product. The gear additive package is typically present in an amount of from about 2 to about 25 weight percent, based on the total weight of the lubricant composition.

Antiwear Agents

The antiwear agents may be phosphorus-containing antiwear agents that may include an organic ester of phosphoric acid, phosphorous acid, or an amine salt thereof. For example, the phosphorus-containing antiwear agent may include one or more of a dihydrocarbyl phosphite, a trihydrocarbyl phosphite, a dihydrocarbyl phosphate, a trihydrocarbyl phosphate, any sulfur analogs thereof, and any amine salts thereof. As a further example, the phosphorus-containing antiwear agent may include at least one of dibutyl hydrogen phosphite and an amine salt of sulfurized dibutyl hydrogen phosphite.

The phosphorus-containing antiwear agent may be present in an amount sufficient to provide about 200 to about 700 parts per million by weight of phosphorus in the lubricant composition. As a further example, the phosphorus-containing antiwear agent may be present in an amount sufficient to provide about 150 to about 450 parts per million by weight of phosphorus in the lubricant composition.

The gear oil additive package component may include from about 1 wt % to about 10 wt % of the phosphorus-containing antiwear agent. As a further example, the gear oil additive package component may include from about 2 wt % to about 10 wt % of the phosphorus-containing antiwear agent. As an example, the gear oil additive package may include from about 4.5 wt % to about 10 wt % of an amyl acid phosphate.

Corrosion Inhibitors

Copper corrosion inhibitors used in the gear oil additive package may include thiazoles, triazoles, and thiadiazoles. Examples include benzotriazole, tolytriazole, octyltriazole, decyltriazole, dodecyltriazole, 2-mercaptobenzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis-(hydrocarbyldithio)-1,3,4-thiadiazoles. Suitable compounds include the 1,3,4-thiadiazoles, especially the 2-hydrocarbyldithio-5-mercapto-1,3,4-dithiadiazoles and the 2,5-bis(hydrocarbyldithio)-1,3,4-thiadiazoles, a number of which are available as articles of commerce. Other suitable inhibitors of copper corrosion include ether amines; polyethoxylated compounds such as ethoxylated amines, ethoxylated phenols, and ethoxylated alcohols; imidazolines; and the like. See, for example, U.S. Pat. Nos. 3,663,561 and 4,097,387. Concentrations of up to about 5 wt. % in the gear oil additive package component are typical. Suitable copper corrosion inhibitors include ashless dialkyl thiadiazoles.

Hydrocarbylamine Compound

In one embodiment, the hydrocarbylamine compound suitable for use in the load carrying capacity enhancing combination is an alkyleneamine compound. A non-limiting class of such compounds includes N-aliphatic hydrocarbyl-substituted trimethylenediamines in which the N-aliphatic hydrocarbyl-substituent is at least one straight chain aliphatic hydrocarbyl group free of acetylenic unsaturation and having in the range of about 14 to about 20 carbon atoms. A non-limiting example of such alkyleneamine compounds for the load carrying capacity enhancing combination is N-oleyl-trimethylene diamine. Other suitable compounds include N-tallow-trimethylene diamine and N-coco-trimethylene diamine.

In another embodiment, the hydrocarbylamines suitable for use in the load carrying capacity enhancing combination comprise primary alkylamines having the general formula: $R'NH_2$, wherein R' is an alkyl group containing up to about 150 carbon atoms and will more often be an aliphatic alkyl group containing from about 4 to about 30 carbon atoms. In one particular embodiment, the hydrocarbylamines are primary alkylamines containing from about 4 to about 30 carbon atoms in the alkyl group, and more preferably from about 8 to about 20 carbon atoms in the alkyl group. The alkyl group can be unsubstituted or substituted, such by substituents described above in connection with the hydrocarbyl group, and reference is made thereto.

Representative examples of primary alkylamines include aliphatic primary fatty amines. Typical fatty amines include alkylamines such as n-hexylamine, n-octylamine, n-decylamine, n-dodecylamine, n-tetradecylamine, n-pentadecylamine, n-hexadecylamine, n-octadecylamine (stearyl amine), and the like. The primary amines are available in both distilled and technical grades. While the distilled grade will provide a purer reaction product, the desirable amides and imides will form in reactions with the amines of technical grade. Also suitable are mixed fatty amines.

In another embodiment, the hydrocarbylamines of the composition of this invention are tertiary-aliphatic primary amines having at least about 4 carbon atoms in the alkyl group, and more particularly from 4 to 30 carbon atoms. Usually the tertiary aliphatic primary amines are monoamines represented by the formula

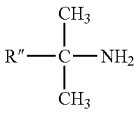

wherein R" is a hydrocarbyl group containing from one to about 30 carbon atoms. Such amines are illustrated by tertiary-butyl amine, tertiary-hexyl primary amine, 1-methyl-1-amino-cyclohexane, tertiary-octyl primary amine, tertiary-decyl primary amine, tertiary-dodecyl primary amine, tertiary-tetradecyl primary amine, tertiary-hexadecyl primary amine, tertiary-octadecyl primary amine, tertiary-tetracosanyl primary amine, tertiary-octacosanyl primary amine.

Mixtures of hydrocarbylamines are also useful for the purposes of this invention. Illustrative of alkylamine mixtures of this type are a mixture of $C_{11}$-$C_{14}$ tertiary alkyl primary amines and a mixture of $C_{18}$-$C_{22}$ tertiary alkyl primary amines. The tertiary alkyl primary amines and methods for their preparation are well known to those of ordinary skill in the art and, therefore, further discussion is unnecessary. The tertiary alkyl primary amine useful for the purposes of this invention and methods for their preparation are described in U.S. Pat. No. 2,945,749 which is hereby incorporated by reference for its teaching in this regard.

Useful secondary alkylamines include dialkylamines having two of the above alkyl groups including fatty secondary amines and also mixed dialkylamines where R' is a fatty amine and R" may be a lower alkyl group (1-9 carbon atoms) such as methyl, ethyl, n-propyl, i-propyl, butyl, etc., or R" may be an alkyl group bearing other non-reactive or polar substituents (CN, alkyl, carbalkoxy, amide, ether, thioether, halo, sulfoxide, sulfone) such that the essentially hydrocarbon character of the radical is not destroyed. The fatty polyamine diamines include mono- or dialkyl, symmetrical or asymmetrical ethylene diamines, propane diamines (1,2, or 1,3), and polyamine analogs of the above. Suitable commercial fatty polyamines include N-coco-1,3-diaminopropane, N-soyaalkyl trimethylenediamine, N-tallow-1,3-diaminopropane, and N-oleyl-1,3-diaminopropane. The hydrocarbyl amine compounds may be present in gear oil additive package in an amount ranging from 4 to about 10 weight percent or more based on a total weight of the additive package.

Rust Inhibitors

Rust inhibitors are another inhibitor additive typically included in the gear oil additive package. Such materials include monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like.

Another useful type of rust inhibitor which may be used is comprised of the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having about 8 to about 24 carbon atoms in the alkenyl group with alcohols such as the polyglycols.

Still other suitable rust inhibitors include ether amines; acid phosphates; amines; polyethoxylated compounds such as ethoxylated amines, ethoxylated phenols, and ethoxylated alcohols; imidazolines; aminosuccinic acids or derivatives thereof, and the like. Materials of these types are available as articles of commerce. Mixtures of such rust inhibitors may be used. The amount of rust inhibitor in the gear oil additive package component may range from about 0.05 to about 5 weight percent based on the total weight of the gear oil additive package.

Antifoam Agents

A foam inhibitor forms another component of the gear oil additive package. Foam inhibitors may be selected from silicones, polyacrylates, surfactants, and the like. The amount of antifoam agent in the gear oil additive package may range from about 0.1 to about 1.0 weight percent based on the total weight of the gear oil additive package.

Process Oil

The process oil used in the gear oil additive package may be a natural oil, a mineral oil, or a blend of such oils. The oil can be paraffinic, naphthenic, or a blend of mineral oils. Pursuant to an embodiment, the process oil is a 60 Neutral mineral oil. The process oil is present in the gear oil additive package in an amount sufficient to solubilize the components of the additive package. Typically, the additive package will contain from about 5 to about 15 percent by weight of the process oil.

TABLE 1

Gear Oil Additive Package

| Component | Weight Percent |
|---|---|
| Polysulfide antiwear agent (component (b)) | 40 to 60 |
| Reaction product of acylated copolymer and polyamine (component (c)) | 30 to 50 |
| Hydrocarbyl amine | 4 to 10 |
| Rust Inhibitor | 0.05 to 5.0 |
| Phosphorus antiwear agent | 2 to 10 |
| Corrosion Inhibitor | 0.5 to 5 |
| Antifoam agent | 0.1 to 1.0 |
| Surfactant | 0.01 to 2 |
| Process Oil | 5 to 15 |

The following non-limiting examples are given to illustrate aspects of the disclosed embodiments. The examples are not intended to limit the embodiments as disclosed herein.

EXAMPLE

A gear oil additive package was formulated generally in accordance with Table 1 and was added to a base oil that included 55 wt. % bright stock base oil and 39 wt. % Group II base oil. The above gear oil formulation had a viscosity grade of 80W-90, and was tested 300 hours for thermal and oxidative stability according to the ASTM D 5704 (L-60-1) using the SAE J2360 procedure. The L60-1 test requires at least a 7.5 carbon/varnish (C/V) rating or higher to pass, and at least a 9.4 sludge rating or higher to pass. The L60-1 rating is based on a merit system with 10 indicating no carbon/varnish and zero representing the worst rating. The additive package aesthetics were also determined after three weeks at temperatures of 4° C., 24° C., and 55° C. A 20 hour KRL shear stability test on the fully formulated lubricant composition was also conducted for each of the samples. All of the samples were effective to pass the D130 copper corrosion bench test (3 hrs at 121° C.). The results are given in the following table.

TABLE 2

| Sample No. | Component (b) wt. % | Component (c) wt. % | Other components wt. % | L60-1, J2360 test | Additive Package Aesthetics | 20 Hour KRL shear Stability | Viscosity Index | Viscosity At −26° C. (cP) |
|---|---|---|---|---|---|---|---|---|
| 1 | 2.6 | 2.0 | 1.3 | Pass | Pass | 6.8% vis. Loss | 173 | 96,000 |
| 2 | 2.0 | 2.0 | 1.0 | Pass | Pass | 6.8% vis. Loss | 172 | 98,000 |
| 3 | 3.3 | 2.5 | 1.6 | Pass | Pass | 9.3% vis. Loss | 176 | 93,000 |
| 4 | 2.6 | 0 | 1.3 | Fail | Pass | 1% vis. Loss | 99 | 152,000 (Fail) |
| 5 | 3.3 | 1.0 | 1.6 | Fail | Pass | 3.1 vis. Loss | 124 | 101,000 |
| 6 | 2.6 | 2.0[1] | 1.3 | Fail | Pass | 15% vis. Loss | 148 | 131,000 |

TABLE 2-continued

| Sample No. | Component (b) wt. % | Component (c) wt. % | Other components wt. % | L60-1, J2360 test | Additive Package Aesthetics | 20 Hour KRL shear Stability | Viscosity Index | Viscosity At −26° C. (cP) |
|---|---|---|---|---|---|---|---|---|
| 7 | 2.0 | 1.0 | 1.0 | Fail | Pass | 3.1 vis. Loss | 122 | 111,000 |
| 8 | 2.6[2] | 2.0 | 1.3 | Pass | Fail | 6.8 vis. Loss | 173 | 97,000 |
| 9 | 2.6 | 3.0 | 1.3 | N/A | Fail | 11.7% vis. Loss | 184 | 103,000 |
| 10 | 3.5 | 2.0 | 1.7 | Fail | Pass | 6.8 vis. loss | 171 | 93,000 |
| 11 | 2.6 | 1.0[3] | 1.3 | Pass | Pass | 1% vis. loss | 98 | 157,000 (Fail) |

[1]Non-dispersant olefin copolymer rather than reaction product of acylated olefin copolymer and polyamine
[2]Sulfurized isobutylene rather than polysulfide
[3]Succinimide dispersant rather than reaction product of acylated olefin copolymer and polyamine From the foregoing table, it is evident that a gear oil lubricant according to the disclosed embodiments may provide superior performance in base oil mixtures that do not include 100 wt. % bright stock base oils. Sample Nos. 1, 2 and 3 were formulations made according to the disclosed embodiments and pass all of the tests required for MT-1 and J2360, L60-1 thermal and oxidative stability, sludge, carbon/varnish limits for clean-gear formulations, viscosity index, and low temperature viscosity tests. Samples 2, 3 and 10 illustrated a suitable operating range for components (b) and (c) in the gear formulations that enabled the formulation to pass all of the tests. As shown by Samples 5 and 7, use of 1 wt. % of component (c) caused the formulation to fail the L60-1 thermal and oxidative stability test. Likewise Sample 4 containing no component (c) also failed the L60-1 test, had too low a viscosity index and failed the low temperature viscosity test. Sample 9 contained 3 wt. % of component (c) resulting in 11.7% viscosity loss on shearing which exceeded the maximum shear loss for the gear oil formulation. Sample 10 containing 3.5 wt. % of component (b) also caused the formulation to fail the L60-1 thermal and oxidative stability test. Sample 6 contained a non-dispersant olefin copolymer rather than component (c) resulting in a 15% viscosity loss on shearing which also exceeded the maximum shear loss for the gear oil formulation. Sample 8 contained a sulfurized isobutylene extreme pressure agent in place of component (b) resulting in a haze formation and failure of the additive package to pass the aesthetics test. Sample 11 contained a succinimide dispersant in place of component (c) resulting in the gear oil formulation not meeting the required viscosity index and failing the low temperature viscosity test.

At numerous places throughout this specification, reference has been made to a number of U.S. patents. All such cited documents are expressly incorporated in full into this disclosure as if fully set forth herein.

Other embodiments of the present invention will be apparent to those skilled in the art from consideration of the specification and practice of the invention disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the invention being indicated by the following claims.

The invention claimed is:

1. A gear oil composition comprising:

a) a major amount of a base oil having a lubricating viscosity comprising from about 55 wt. % to less than 100 wt. % bright stock base oil;

b) a polysulfide extreme pressure agent; and c) a reaction product of an acylated olefin copolymer and 4-anilino-4'-nitroazobenzene in an amount ranging from greater than about 1.0 wt. % to less than about 3.0 wt. % based on a total weight of the gear oil composition, wherein the acylated olefin copolymer has grafted thereon from 0.3 to 0.75 carboxylic groups per 1000 number average molecular weight units of olefin copolymer and wherein the olefin copolymer has a number average molecular weight of between about 40,000 and 150,000, wherein the amounts of components (b) and (c) are sufficient to provide a carbon/varnish rating of at least 7.5 and a sludge rating of at least 9.4 according to ASTM D5704 (L60-1) using a SAJ2360 procedure.

2. The gear oil of claim 1, wherein the polysulfide comprises an alkyl polysulfide.

3. The gear oil of claim 2 wherein the polysulfide is selected from the group consisting of dicyclohexyl polysulfide, diphenyl polysulfide, dibenzyl polysulfide, dinonyl polysulfide, and mixtures of di-t-butyl polysulfides.

4. The gear oil of claim 1, wherein the polysulfide component is present in the gear oil in an amount ranging from about 2.0 to about 3.3 wt. % based on a total weight of the gear oil.

5. A gear oil additive concentrate comprising (i) a polysulfide extreme pressure agent and (ii) a reaction product of an acylated olefin copolymer and 4-anilino-4'-nitroazobenzene in an amount ranging from greater than about 1.0 wt. % to less than about 3.0 wt. % based on a total weight of a gear oil composition containing the concentrate, wherein the acylated olefin copolymer has grafted thereon from 0.3 to 0.75 carboxylic groups per 1000 number average molecular weight units of olefin copolymer and wherein the olefin copolymer has a number average molecular weight of between about 40,000 and 150,000, wherein a weight ratio of reaction product to polysulfide in the additive concentrate ranges from about 0.3:1 to about 1.5:1 and the additive package comprises from about 40 to about 60 wt. % of the polysulfide, wherein the amounts of components (i) and (ii) are sufficient to provide a carbon/varnish rating of at least 7.5 and a sludge rating of at least 9.4 according to ASTM D5704 (L60-1) using a SAJ2360 procedure, for a gear oil composition containing from about 55 wt. % less than 100 wt. % bright stock base oil.

6. The additive concentrate of claim 5, wherein the polysulfide comprises an alkyl polysulfide.

7. The additive concentrate of claim 6, wherein the polysulfide is selected from the group consisting of dicyclohexyl polysulfide, diphenyl polysulfide, dibenzyl polysulfide, dinonyl polysulfide, and mixtures of di-t-butyl polysulfides.

8. A method for lubricating an automotive gear comprising:

supplying to an automotive gear, a gear oil comprising:

a) a major amount of base oil comprising from about 55 wt. % to less than 100 wt. % bright stock base oil;

b) a polysulfide extreme pressure agent; and c) a reaction product of an acylated olefin copolymer and 4-anilino-4'-nitroazobenzene in an amount ranging from greater than about 1.0 wt. % to less than about 3.0 wt. % based on a total weight of the gear oil, wherein the acylated olefin copolymer has grafted thereon from 0.3 to 0.75 carboxylic groups per 1000 number average molecular weight units of olefin copolymer and wherein the olefin copolymer has a number average molecular weight of between about 40,000 and 150,000;

and operating a vehicle containing the automotive gear to lubricate the gear, wherein the amounts of components (b) and (c) are sufficient to provide a carbon/varnish rating of at least 7.5 and a sludge rating of at least 9.4 according to ASTM D5704 (L60-1) using a SAJ2360 procedure.

9. A method for improving the performance of a gear oil made with from about 55 wt. % to less than 100 wt. % bright stock base oil, comprising formulating the gear oil with a major amount of base oil and an additive mixture comprising (i) a polysulfide extreme pressure agent and (ii) a reaction product of an acylated olefin copolymer and 4-anilino-4'-nitroazobenzene in an amount ranging from greater than about 1.0 wt. % to less than about 3.0 wt. % based on a total weight of the gear oil, wherein the acylated olefin copolymer has grafted thereon from 0.3 to 0.75 carboxylic groups per 1000 number average molecular weight units of olefin copolymer and wherein the olefin copolymer has a number average molecular weight of between about 40,000 and 150,000, and wherein the amounts of components (i) and (ii) are sufficient to provide a carbon/varnish rating of at least 7.5 and a sludge rating of at least 9.4 according to ASTM D5704 (L60-1) using a SAJ2360 procedure.

* * * * *